US011855330B2

(12) United States Patent
Ahlström et al.

(10) Patent No.: US 11,855,330 B2
(45) Date of Patent: Dec. 26, 2023

(54) REFLECTOR FOR A MULTI-RADIATOR ANTENNA

(71) Applicant: Cellmax Technologies AB, Kista (SE)

(72) Inventors: Alf Ahlström, Spånga (SE); Anders Edquist, Täby (SE)

(73) Assignee: CELLMAX TECHNOLOGIES AB, Kista (SE)

( * ) Notice: Subject to any disclaimer, the term of this patent is extended or adjusted under 35 U.S.C. 154(b) by 0 days.

(21) Appl. No.: 17/762,639

(22) PCT Filed: Dec. 13, 2021

(86) PCT No.: PCT/SE2021/051241
§ 371 (c)(1),
(2) Date: Mar. 22, 2022

(87) PCT Pub. No.: WO2022/132001
PCT Pub. Date: Jun. 23, 2022

(65) Prior Publication Data

US 2023/0170623 A1 Jun. 1, 2023

(30) Foreign Application Priority Data

Dec. 14, 2020 (SE) ..... 2051458-4

(51) Int. Cl.
*H01Q 15/14* (2006.01)
*H01Q 5/307* (2015.01)
(Continued)

(52) U.S. Cl.
CPC ..... *H01Q 15/14* (2013.01); *H01Q 5/20* (2015.01); *H01Q 5/307* (2015.01); *H01Q 19/10* (2013.01); *H01Q 19/108* (2013.01)

(58) Field of Classification Search
CPC ..... H01Q 15/14; H01Q 5/307; H01Q 19/10; H01Q 1/38; H01Q 19/108; H01Q 5/10;
(Continued)

(56) References Cited

U.S. PATENT DOCUMENTS 11,362,437 B2 * 6/2022 Piegsa ..... H01Q 19/108
2004/0201543 A1 10/2004 Gottl et al.
(Continued)

FOREIGN PATENT DOCUMENTS

CN 113451742 A * 9/2021 ..... H01Q 1/246
DE 102018120612 A1 * 8/2019 ..... H01Q 1/241
(Continued)

OTHER PUBLICATIONS

Antenna System For Base Station Of Mobile Communication Network, Has Reflector With Reflector Apertures For Coupling Signal Distribution Network With Radiation Elements, Where Flexible Foil Is Coupled To Top Or Bottom Portion Of Housing. Helbig et al. (Year: 2022).*
(Continued)

*Primary Examiner* — Vibol Tan
(74) *Attorney, Agent, or Firm* — The Jansson Firm; Pehr B. Jansson

(57) ABSTRACT

A reflector for a multi-radiator antenna which comprises electrically conducting reflector parts and one or more connector device. At least two reflector parts are each provided with at least one connecting portion. At least one connector device is adapted to provide an electrical interconnection between at least two of the reflector parts. At least one connector device comprises a metallic film and one or more holding elements. The metallic film is adapted to be arranged in abutment with connecting portions of the at least two of the reflector parts to achieve the electrical interconnection. At least one of the holding elements has at least one
(Continued)

holding portion adapted to connect to a connecting portion of a reflector part with said metallic film sandwiched therebetween. The electrical interconnection is indirect by means of a dielectric coating or layer arranged on the metallic film and/or on the connecting portions, or by means of a dielectric film arranged between the metallic film and the connecting portions.

22 Claims, 6 Drawing Sheets

(51) Int. Cl.
*H01Q 19/10* (2006.01)
*H01Q 5/20* (2015.01)

(58) Field of Classification Search
CPC ..... H01Q 5/20; H01Q 1/521; H01Q 15/141; H01Q 21/0087; H01Q 9/04; H01Q 9/0407
See application file for complete search history.

(56) References Cited

U.S. PATENT DOCUMENTS

2004/0263389 A1 12/2004 Haunberger et al.
2022/0352644 A1* 11/2022 Chen ..... H01Q 5/357

FOREIGN PATENT DOCUMENTS

WO WO-0057514 A1 * 9/2000 ..... H01Q 19/10
WO WO-2004091042 A1 * 10/2004 ..... H01Q 1/12
WO WO2005101566 A1 10/2005
WO WO2014120062 A1 8/2014
WO WO-2022131648 A1 * 6/2022

OTHER PUBLICATIONS

PCT/SE2021/051241 International Search Report, dated Jan. 10, 2022, Patent-och registreringsverket Box 5055 S-102 42 Stockholm, Sweden.

* cited by examiner

REFLECTOR FOR A MULTI-RADIATOR ANTENNA

TECHNICAL FIELD

The present invention relates to the field of base station antennas for mobile communication.

BACKGROUND

Base station antennas for mobile communication normally comprise an antenna feeding network, an electrically conductive reflector and a plurality of antenna elements (for example dipoles) arranged on the reflector. The radiators are typically arranged in columns, each column of radiators forming one antenna.

Radiators are commonly placed as an array on the reflector or ground plane, in most cases as a one-dimensional array extending in the vertical plane, but also two-dimensional arrays are used.

The purpose of the antenna feeding network is to distribute the signals from a common connector to all antenna elements of an array when transmitting, and combining the signals from all the antenna elements to the same common connector when receiving. Such an antenna feeding network can be realized using soft coaxial cables using e.g. PTFE as dielectric between inner and outer conductor, or air-filled coaxial lines as disclosed in WO2005/101566A1, or stripline technology with a flat conductor being placed between two ground planes, or microstrip technology using a flat conductor placed over a ground planes, or any other transmission line technology or a combination of the technologies cited above. In all those cases, is possible to use a dielectric as e.g. PTFE between the conductor and the ground plane, or just air. The latter will result in significantly lower losses.

As the number of frequency bands used at for mobile communication has increased over the years, it has become advantageous to re-group antennas frequency bands into a multi-band antenna. A common solution is to have a Low Band (LB) antenna covering several frequency bands (for instance for the frequency range 600-900 MHz) combined with one or more High Band (HB) antennas (for instance for the frequency range 1700-2600 MHz) into a multi-band antenna. Such multi-band antennas can be implemented using antenna feeding networks as disclosed in WO2005/101566A1. An example of such a multi-band antenna is disclosed in WO2014/120062A1. Another example is shown in FIG. 1. These antennas comprise two HB arrays and one LB array. The three reflectors/feeding networks are all formed from a single extruded aluminium profile.

In some cases, the operator wants to have several arrays, one for each frequency band he uses. This can be advantageous if the operator has a license for several frequency bands within the frequency range of the antenna, or if MIMO is used to combine the signals from several spatially separated arrays, Multi-array antennas using extruded feeding networks comprising even more arrays are desirable but have proven difficult to manufacture since extrusion of even wider aluminium profiles is difficult, in particular with the relatively strict tolerances required.

Another aspect is that different cellular operators often require different combinations of frequency ranges, and even the same operator may want different number of arrays of frequency ranges on different geographic locations. This makes it difficult for an antenna supplier as he has to keep a large number of antennas in stock in order to respond swiftly.

Thus, there is a need for an improved multi-band antenna covering further frequency bands and/or being more flexible in terms of frequency coverage, while maintaining the high performance of the above-mentioned antennas.

SUMMARY

An object of the invention is to solve or improve on at least some of the problems mentioned above in the background section.

These and other objects are achieved by the present invention by means of a reflector for a multi-radiator antenna according to the independent claim.

According to a first aspect of the invention, a reflector for a multi-radiator antenna is provided. The reflector comprises two or more electrically conducting reflector parts and one or more connector device. At least two of the reflector parts (or all reflector parts) are each provided with at least one connecting portion. At least one connector device is adapted to provide an electrical interconnection between the at least two of the reflector parts. Each or at least one connector device comprises a metallic film and one or more holding elements. The metallic film is adapted to be arranged in abutment with connecting portions of the at least two of the reflector parts to achieve the electrical interconnection. At least one of the holding elements has at least one holding portion adapted to connect to a connecting portion of a reflector part with the metallic film sandwiched therebetween. The electrical interconnection is indirect by means of a dielectric coating or layer arranged on the metallic film and/or on the connecting portions, or by means of a dielectric film arranged between the metallic film and the connecting portions. The holding element(s) of the connector devices may be non-conductive. The indirect interconnection may be capacitive.

In other words, the reflector is formed by at least two reflector parts which are interconnected using one or more connector device(s). The connector device(s) is/are adapted to interconnect two, three or more reflector parts. The interconnection is preferably primarily electrical, i.e. one or more further mechanical connectors are provided to hold the reflector parts together mechanically. It is however foreseeable that the connector device and one or more mechanical connectors are formed as a combined unit. The electrical interconnection is provided via the metallic film and is indirect (capacitive for instance) due to the dielectric layer or film which makes contact with the connecting portions when the connector device is connected thereto. The reflector parts are normally elongated and extend in a lengthwise direction of the reflector/antenna and are arranged in parallel side by side to form the reflector.

The invention is based on the insight that an antenna covering further frequency bands and/or being more flexible in terms of frequency coverage can be achieved by making the antenna modular by having a reflector formed from two or more reflector parts, where the reflector parts are indirectly interconnected (rather than galvanically) in order to achieve low passive intermodulation (PIM). To achieve an effective indirect interconnection, it is important that the dielectric material is held in close abutment with the contact surfaces of the reflector parts (without air gaps). The dielectric material is preferably thin and has a high dielectric constant in order to maximise the capacitance as this improves the electrical interconnection. Production tolerances make it difficult to avoid air gaps at the connecting portions of the reflector parts, however. The invention is further based on the insight that air gaps can be avoided by separating the mechanical and electrical interconnection of the reflector parts, in the sense that a sturdy mechanical interconnection allows the separate electrical interconnection to be flexible or resilient which means that it can be held in closed abutment with contact portions of the reflector parts even if the distance between the reflector parts (due to production tolerances) varies somewhat along the extension of the reflector parts. The invention is furthermore based on the insight that such flexible or resilient electrical interconnection is advantageously achieved by means of a metallic film arranged in contact with connecting portions of the reflector parts, and that an indirect electrical interconnection is advantageously achieved by means of a dielectric coating, layer or film arranged on the reflector parts and/or on the metallic film or therebetween. The invention is furthermore based on the insight that the metallic film and the dielectric coating/layer/film may be held in abutment with respective contact surfaces of the reflector parts by means of one or more holding elements, which preferably is/are resilient.

In embodiments of a reflector according to the first aspect of the invention, the dielectric coating or layer is arranged on the metallic film on at least the side thereof facing the connecting portions. The metallic film may be provided with a dielectric coating or layer on both sides. The metallic film may be provided with an adhesive coating or layer on the side thereof facing the holding element, or on the side thereof facing the contact surfaces of the reflector parts, to adhere thereto, which adhesive layer may be dielectric.

In embodiments of a reflector according to the first aspect of the invention, at least one, or each, holding element is resilient, for instance by being made at least partly, or wholly, from a resilient material or by comprising a resilient portion, to force the metallic film against the connecting portions of said at least two of the reflector parts when connected thereto. More specifically, at least the holding portions of the at least one holding element may be resilient to force the metallic film against the connecting portions of said at least two of the reflector parts.

In embodiments of a reflector according to the first aspect of the invention, at least one, or each, holding element comprises at least one spring part/portion adapted to force the at least one holding portion towards the connecting portions of the at least two of the reflector parts when connected thereto. At least one spring portion may be formed integrally with the holding element.

In embodiments of a reflector according to the first aspect of the invention, at least one, or each, holding portion of the holding element is configured to connect with a corresponding connecting portion of a reflector part by means of abutting contact therewith. This embodiment is advantageously combined with the above-described embodiments having a resilient holding element/portion or a holding element having a spring part/portion to achieve the abutting contact.

In embodiments of a reflector according to the first aspect of the invention, at least one, or each, holding portion of at least one holding element is configured to connect with a corresponding connecting portion of a reflector part by engaging around at least parts of the connecting portion. For instance, the holding portion may be formed as a fork having tines/fingers adapted to receive the connecting portion therebetween. Alternatively, the holding portion may be formed as flexible snap on fingers adapted to be snapped onto the connecting portion.

In embodiments of a reflector according to the first aspect of the invention, at least one, or each, holding portion of at least one holding element, or the holding element as a whole, is resiliently compressible and is configured to connect with a corresponding connecting portion of a reflector part by means of the connecting portion being formed as a cavity into which the holding portion is releasably insertable.

In embodiments of a reflector according to the first aspect of the invention, the at least two reflector parts comprises first and second reflector parts, wherein the first reflector part comprises a first connecting portion formed as a protrusion, and wherein the second reflector part comprises a second connecting portion formed as a cavity adapted to receive said first connecting portion and at least parts of a connector device to electrically interconnect said first and second reflector parts. The connector device comprises a holding element being at least partly resiliently compressible and being adapted to connect to the first and second connecting portions with said metallic film sandwiched therebetween. The connector device may further comprise one or more additional holding elements, which optionally may also be resiliently compressible.

In embodiments of a reflector according to the first aspect of the invention, at least one, or each, connector device comprises at least one holding element having at least two holding portions, wherein the metallic film extends between the holding portions by at least partly surrounding the periphery of the holding element. Advantageously, the at least one connector device comprises holding portions at opposite ends thereof with a spring portion or part therebetween. In such an embodiment, the inherent flexible/bendable properties of the metallic film allow the connector to compress and expand by means of the spring portion or part to adapt to a varying distance between the reflector parts to which it is connected.

In embodiments of a reflector according to the first aspect of the invention, at least one, or each, connector device extends along essentially the whole length of the reflector parts when connected thereto. In such embodiments, the connector device(s) may be formed by a metallic film adapted to the length(s) of the reflector parts along with a holding element of corresponding length adapted to connect to a connecting portion of a reflector part with the metallic film sandwiched therebetween. Alternatively, the connector device comprises at least two holding elements adapted to be arranged consecutively along the length of the reflector parts to connect to a connecting portion of a reflector part with the (common) metallic film sandwiched therebetween.

In an alternative embodiment of a reflector according to the first aspect of the invention, at least two connector devices are arranged consecutively along the length of the reflector parts when connected thereto.

In embodiments of a reflector according to the first aspect of the invention, the reflector comprises at least two parallel reflector portions to form a reflector for a multi-array antenna arrangement having at least two arrays of antenna elements, wherein at least one reflector portion is formed by at least two reflector parts. In other words, the reflector comprises two parallel reflector portions, each acting as a reflector for one or more arrays of antenna elements. Each array of antenna elements is preferably attached to a corresponding reflector part. In this embodiment, all reflector parts are electrically connected to form a common antenna reflector, and the antenna elements use not only the reflector part to which they are attached as its reflector; this reflector part interacts with one or more adjacent reflector parts in such a way as to form a larger reflector (reflector portion)

than the reflector part to which said antenna elements are attached. This is advantageous since the overall width of the reflector can be reduced compared to if adjacent reflector parts would not interact to form larger reflector portions. Reducing the width of the reflector (and consequently the antenna arrangement as a whole) is advantageous for several reasons. Firstly, a smaller width reduces the wind load on the antenna which allows the use of less costly antenna masts. Secondly, operators commonly pay rent for the antenna locations based on the width of the antenna.

According to a second aspect of the invention, a multi-array antenna arrangement is provided. The multi-array antenna arrangement comprises a reflector according to the first aspect of the invention or embodiments thereof. At least two of the reflector parts are each provided with an antenna feeding network module and at least two antenna elements arranged on the reflector part and being electrically connected to the antenna feeding network module. The antenna feeding network modules may comprise at least two transmission lines having at least one inner conductor arranged in parallel with an elongated outer conductor with air therebetween. The antenna feeding network may also incorporate variable phase shifting devices in order adjust the tilt of the antenna beam. The transmission lines may be coaxial lines, where the inner conductor is at least partly surrounded with the outer conductor, and where the space between is substantially air filled (apart from any holding elements holding the inner conductor in position, any dielectric elements or associated parts for phase shifting purposes or the like). Alternatively, the transmission lines may have flat conductors (strip) placed between two ground planes (a stripline) or essentially interacting with only one ground plane (a microstrip). A dielectric material may also be included between the strip and one or two ground planes in order to increase the dielectric constant and reduce the size of the strip. The antenna feeding network modules are preferably formed integrally with the corresponding reflector part, for instance as an extruded aluminium profile. Alternatively, commonly available bendable coaxial cables using e.g. PTFE or PE as dielectric can be used.

A modular arrangement as described above is advantageous since with e.g. just two frequency bands, the antenna manufacturer can keep only those modules in stock, and assemble them according to the requirements of his customer, thus being able to respond fast and keep a minimum of stock.

In embodiments of a multi-array antenna arrangement according to the second aspect of the invention, at least one antenna feeding network module is disposed substantially perpendicular to the corresponding reflector part, or more specifically perpendicular to a plane defined by the front (reflecting) surface of the reflector part. Put differently, the inner conductors of the transmission lines are disposed in one or more planes which is/are substantially perpendicular to the corresponding reflector part. This differs from prior art antenna feeding networks of this type (such as WO2005/101566) where the antenna feeding network is normally arranged in parallel with the reflector. Having one or more antenna feeding network modules arranged perpendicularly may reduce the width of the antenna arrangement in embodiments where the width of the antenna is limited by the width of the antenna feeding networks. Alternatively, an advantage can be that the cross-section of conductors does not need to be reduced (when using parallel feeding networks) to meet a certain antenna width constraint, thus avoiding losses.

In embodiments of a multi-array antenna arrangement according to the second aspect of the invention, at least one reflector part along with its corresponding antenna feeding network module(s) and antenna elements each forms a multi-radiator antenna having its reflector formed partly by said reflector part and partly by one or more adjacent reflector parts. In other words, at least one multi-radiator antenna is formed with its reflector not only formed by the reflector part to which the at least two antenna elements are connected, but also by (parts) of an adjacent reflector part. This is advantageous since antenna modules (comprising a reflector part, an antenna feeding network module and antenna elements) can be pre-assembled prior to assembling the antenna arrangement as a whole. One prime issue when manufacturing antennas is that PIM (Passive InterModulation) must be low. PIM is often depending on how well metal parts are assembled together. In an antenna with several arrays, if in production PIM is not according to specification, it can be difficult to identify which array is responsible for causing PIM, and it can be quite cumbersome to correct. Therefore, it is highly advantageous to have pre-assembled modules/arrays which can be tested for e.g. PIM before the modules/arrays are assembled to form the multi-array antenna. Further, the overall width of the antenna arrangement can be reduced compared to if each antenna module would comprise its entire reflector.

According to a third aspect of the invention, a method for assembling a reflector for a multi-radiator antenna is provided. The method comprises providing at least two electrically conducting reflector parts, each having at least one connecting portion, providing at least one connector device comprising a metallic film and at least one holding element, each having at least one holding portion, and interconnecting the at least two reflector parts electrically using the connector device by connecting at least two holding portions of the at least one holding element to at least one connecting portion of each of said at least two reflector parts with the metallic film sandwiched therebetween. The holding element may be non-conductive.

In embodiments of the method according to third aspect of the invention, the metallic film comprises a dielectric coating or layer on at least one side thereof, and said interconnecting comprises arranging the metallic film with its dielectric coating or layer in abutment with the reflector parts.

In embodiments of the method according to third aspect of the invention, the at least two electrically conducting reflector parts comprises a dielectric coating or layer on said at least one connecting portion.

In embodiments of the method according to third aspect of the invention, the method further comprises providing at least one dielectric film, and arranging it between the metallic film and the connecting portions.

In embodiments of the method according to third aspect of the invention, the method further comprises providing at least one dielectric film with an adhesive on at least one side with the adhesive facing either the metallic film and/or the connecting portions.

According to a fourth aspect of the invention, a reflector for a multi-radiator antenna is provided. The reflector comprises two or more electrically conducting reflector parts and at least one connector device adapted to provide an indirect electrical interconnection between at least two of the reflector parts. In other words, the reflector is formed by at least two reflector parts which are interconnected using one or more connector device(s). The connector device(s) is/are adapted to interconnect two, three or more reflector parts. The reflector parts are normally elongated and extend in a lengthwise direction of the reflector/antenna and are arranged in parallel side by side to form the reflector.

In embodiments of the fourth aspect of the invention, the reflector further comprises at least one mechanical connector adapted to connect the reflector parts solely mechanically. The mechanical connector may comprise one or more bolts, screws, clamps or other known mechanical connection means for connecting mechanically to the reflector parts. In other words, the connector device interconnects the two or more reflector parts primarily electrically, and a mechanical connector is provided to provide necessary mechanical strength in the connection.

In embodiments of the fourth aspect of the invention, the two or more electrically conducting reflector parts form at least two parallel reflector portions for a multi-array antenna arrangement having at least two arrays of antenna elements, wherein at least one reflector portion is formed by at least two reflector parts. In other words, the reflector comprises two parallel reflector portions, each acting as a reflector for an array of antenna elements.

According to a fifth aspect of the invention, a multi-array antenna arrangement is provided, which comprises a reflector according to the fourth aspect of the invention or embodiments thereof, wherein at least two of the reflector parts, together with at least two antenna elements arranged on the respective reflector part and an antenna feeding network module being electrically connected to the at least two antenna elements, each form an antenna module. In other words, at least two antenna modules are formed, each from a reflector part, at least two antenna elements being attached thereto and an antenna feeding network module being electrically connected to the at least two antenna elements. At least one of the antenna modules forms a multi-radiator antenna having its reflector formed partly by its reflector part and partly by a reflector part of an adjacent antenna module.

In embodiments of the fifth aspect of the invention, at least one, or each, antenna feeding network module comprises at least two transmission lines having at least one inner conductor arranged in parallel with an elongated outer conductor with air therebetween. The transmission lines may be coaxial lines, where the inner conductor is at least partly surrounded with the outer conductor, and where the space between is substantially air filled (apart from any holding elements holding the inner conductor in position, any dielectric elements or associated parts for phase shifting purposes or the like). Alternatively, the transmission lines may have flat conductors (strips) placed between two ground planes (a stripline) or essentially interacting with only one ground plane (a microstrip). A dielectric material may also be included between the strip and one or two ground planes in order to increase the dielectric constant and reduce the size of the strip. The antenna feeding network modules are preferably formed integrally with the corresponding reflector part, for instance as an extruded aluminium profile. Alternatively, commonly available coaxial cables using e.g. PTFE or PE as dielectric can be used.

In embodiments of the fourth or fifth aspect of the invention, at least two reflector parts are each provided with at least one connecting portion. Each or at least one connector device comprises a metallic film and one or more holding elements. The metallic film is adapted to be arranged in abutment with connecting portions of said at least two of the reflector parts to achieve the electrical interconnection. At least one of the holding elements has at least one holding portion adapted to connect to a connecting portion of a reflector part with the metallic film sandwiched therebetween. The electrical interconnection is indirect by means of a dielectric coating or layer arranged on the metallic film and/or on the connecting portions, or by means of a dielectric film arranged between the metallic film and the connecting portions. The holding element(s) of the connector devices may be non-conductive. The indirect interconnection may be capacitive.

In embodiments of the fourth or fifth aspect of the invention, the dielectric coating or layer is arranged on the metallic film on at least the side thereof facing the connecting portions. The metallic film may be provided with a dielectric coating or layer on both sides.

In embodiments of the fourth or fifth aspect of the invention, at least one, or each, holding element is resilient, for instance by being made at least partly, or wholly, from a resilient material or by comprising a resilient portion, to force the metallic film against the connecting portions of said at least two of the reflector parts when connected thereto. More specifically, at least the holding portions of the at least one holding element may be resilient to force the metallic film against the connecting portions of said at least two of the reflector parts.

In embodiments of the fourth or fifth aspect of the invention, at least one, or each, holding element comprises at least one spring part/portion adapted to force the at least one holding portion towards the connecting portions of said at least two of the reflector parts when connected thereto. At least one spring portion may be formed integrally with the holding element.

In embodiments of the fourth or fifth aspect of the invention, at least one holding portion of the holding element is configured to connect with a corresponding connecting portion of a reflector part by means of abutting contact therewith. This embodiment is advantageously combined with the above-described embodiments having a resilient holding element/portion or a holding element having a spring part/portion to achieve the abutting contact.

In embodiments of the fourth or fifth aspect of the invention, at least one, or each, holding portion of at least one holding element is configured to connect with a corresponding connecting portion of a reflector part by engaging around at least parts of the connecting portion. For instance, the holding portion may be formed as a fork having tines/fingers adapted to receive the connecting portion therebetween. Alternatively, the holding portion may be formed as flexible snap on fingers adapted to be snapped onto the connecting portion.

In embodiments of the fourth or fifth aspect of the invention, at least one, or each, holding portion of at least one holding element, or the holding element as a whole, is resiliently compressible and is configured to connect with a corresponding connecting portion of a reflector part by means of the connecting portion being formed as a cavity into which the holding portion is releasably insertable.

In embodiments of the fourth or fifth aspect of the invention, the at least two reflector parts comprises first and second reflector parts, wherein the first reflector part comprises a first connecting portion formed as a protrusion, and wherein the second reflector part comprises a second connecting portion formed as a cavity adapted to receive said first connecting portion and at least parts of a connector device to electrically interconnect said first and second reflector parts. The connector device comprises a holding element being at least partly resiliently compressible and being adapted to connect to the first and second connecting portions with said metallic film sandwiched therebetween.

The connector device may further comprise one or more additional holding elements, which optionally may also be resiliently compressible.

In embodiments of the fourth or fifth aspect of the invention, at least one connector device comprises at least one holding element having at least two holding portions, wherein the metallic film extends between the holding portions by at least partly surrounding the periphery of the holding element. Advantageously, the at least one connector device comprises holding portions at opposite ends thereof with a spring portion or part therebetween. In such an embodiment, the inherent flexible/bendable properties of the metallic film allow the connector to compress and expand by means of the spring portion or part to adapt to a varying distance between the reflector parts to which it is connected.

In embodiments of the fourth or fifth aspect of the invention, at least one, or each, connector device extends along essentially the whole length of the reflector parts when connected thereto. In such embodiments, the connector device(s) may be formed by a metallic film adapted to the length(s) of the reflector parts along with a holding element of corresponding length adapted to connect to a connecting portion of a reflector part with the metallic film sandwiched therebetween. Alternatively, the connector device comprises at least two holding elements adapted to be arranged consecutively along the length of the reflector parts to connect to a connecting portion of a reflector part with the (common) metallic film sandwiched therebetween.

In embodiments of the fourth or fifth aspect of the invention, at least two connector devices are arranged consecutively along the length of the reflector parts when connected thereto.

According to a sixth aspect of the invention, a method for manufacturing a multi array antenna is provided. The method comprises manufacturing modules comprising at least one reflector part, at least two antenna elements and at least one antenna feeding network, testing the modules, and assembling the modules to form a multi array antenna according to customer needs in terms of e.g. frequency bands and number of arrays. Stocking just antenna modules which can form different types of multi array antennas significantly reduces the cost for maintaining a stock of antennas for fast delivery.

The features of the embodiments described above are combinable in any practically realizable way to form embodiments having combinations of these features. Further, all features and advantages of embodiments described above with reference to the first, second, third, fourth, fifth and sixth aspects of the invention may be applied in corresponding embodiments of any aspect of the invention.

BRIEF DESCRIPTION OF THE DRAWINGS

Above discussed and other aspects of the present invention will now be described in more detail using the appended drawings, which show presently preferred embodiments of the invention, wherein.

DETAILED DESCRIPTION

Figure 1:
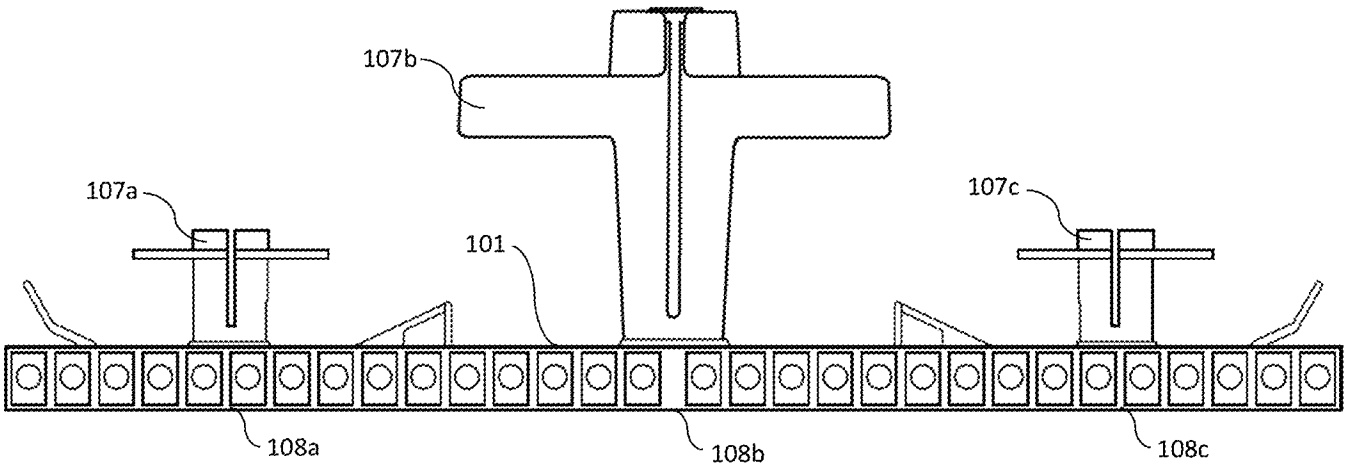
FIG. 1 is a schematic illustration of a prior art multi-band antenna comprising a reflector formed as a single extruded aluminium profile.

FIG. 1 is a schematic cross section illustration of a prior art multi-band antenna comprising a reflector formed as a single extruded aluminium profile. The antenna comprises a reflector 101 formed integrally with the antenna feeding networks 108*a-c* as an extruded aluminium profile. Each antenna feeding network comprises a number of coaxial lines, each formed by a central inner conductor surrounded by an outer conductor formed by a compartment in the aluminium profile with air between the inner and outer conductors. Three arrays of antenna elements 107*a*, 107*b*, 107*c* (only one antenna element of each array can be seen in the shown cross section) are arranged consecutively in the lengthwise direction of the antenna on the reflector 101 to form one Low Band (LB) multi-radiator antenna (antenna elements 107*b*) and two High Band (HB) multi-radiator antennas (antenna elements 107*a*, 107*c*). The arrays of antenna elements 107*a-c* are electrically connected to a corresponding feeding network 108*a-c*.

Figure 2:
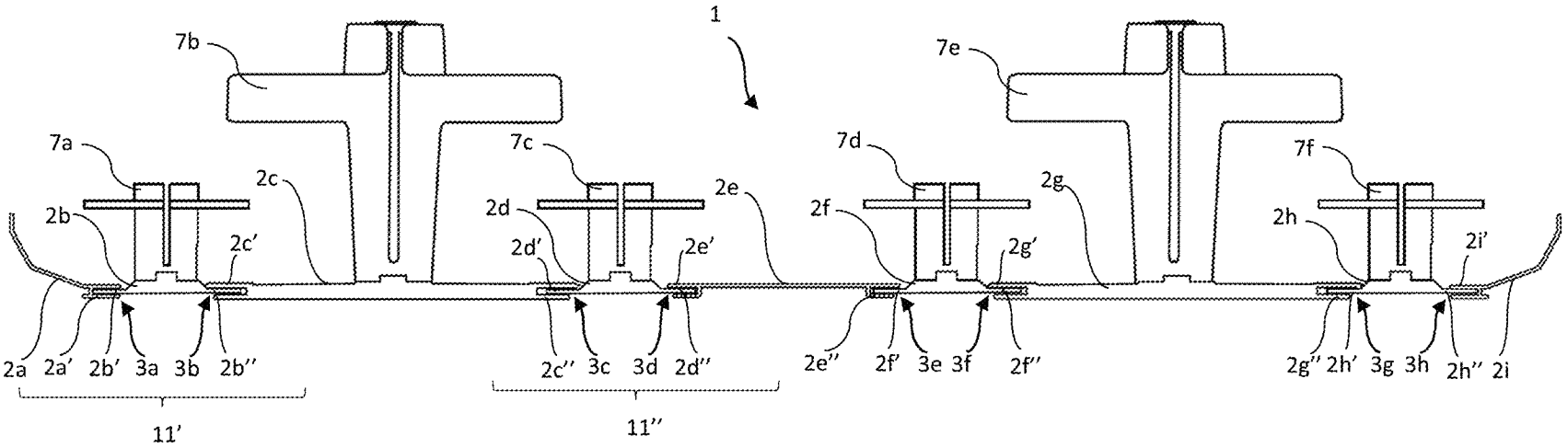
FIG. 2 is a schematic illustration of an embodiment of a reflector according to the first or fourth aspect of the invention.

FIG. 2 is a schematic cross section illustration of an embodiment of a reflector 1 according to the first or fourth aspect of the invention. In this embodiment, the reflector comprises electrically conducting reflector parts 2*a*-2*i* and connector devices 3*a*-3*h* which electrically interconnect the reflector parts in an indirect (capacitive) manner to form the reflector 1. Reflector part 2*a* is provided with connecting portion 2*a*' in the form of a cavity in which a protruding connecting portion 2*b*' of reflector part 2*b* and a connector device 3*a* are received, which electrically interconnects reflector parts 2*a* and 2*b*. In a corresponding manner protruding connecting portions 2*b*", 2*d*', 2*d*", 2*f*', 2*f*", 2*h*' and 2*h*" are received together with corresponding connector devices 3*b*, 3*c*, 3*d*, 3*e*, 3*f*, 3*g*, 3*h* in corresponding connecting portions 2*c*', 2*c*", 2*e*', 2*e*", 2*g*', 2*g*", 2*i*' of adjacent reflector parts. The connector devices are disclosed in more detail in FIG. 5. The reflector parts 2*a*-2*i* are elongated and extend in a lengthwise direction (depth direction in the figure) of the reflector/antenna and are arranged in parallel side by side to form the reflector 1. The connector devices 3*a*-3*h* extend along the whole length of the reflector parts.

The reflector parts 2*b*, 2*d*, 2*f* and 2*h* are each provided with an array of antenna elements 7*a*, 7*c*, 7*d*, 7*f* (only one of each array can be seen in the shown cross section) arranged consecutively in the lengthwise direction of the antenna on the reflector. A reflector portion is formed for each array of antenna elements, wherein each reflector portion is formed by at least two reflector parts. As illustrated in the figure, a reflector portion indicated by 11' for array 7*a* is formed by not only reflector part 2*b* to which they are connected, but also by reflector part 2*a* and partly reflector part 2*c*. In the same manner, a reflector portion indicated by 11" for array 7*c* is formed by reflector parts 2*c*, 2*d* and 2*e*. In a corresponding manner, a reflector portion for array 7*b* is formed by reflector parts 2*b*, 2*c*, 2*d* and to some extent also 2*a* and 2*e*. It is understood that reflector portions for arrays 7*d*, 7*e* and 7*f* are formed in a corresponding manner. In this way, larger reflector portions than the reflector part to which said antenna elements are attached are formed. Arrays 7*a*, 7*c*, 7*d* and 7*f* each form a HB multi-radiator antenna, and arrays 7*b* and 7*e* each form a LB multi-radiator antenna.

Figure 3:
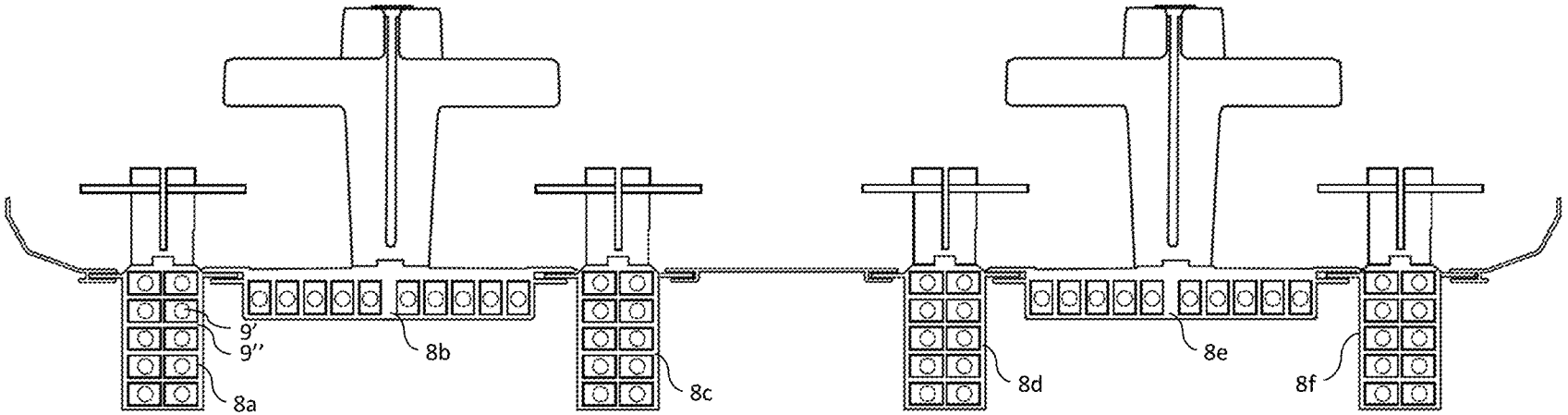
FIG. 3 is a schematic illustration of an embodiment of a multi-array antenna arrangement according to the second or fifth aspect of the invention, which comprises the reflector shown in FIG. 2.

FIG. 3 is a schematic illustration of an embodiment of a multi-array antenna arrangement according to the second or fifth aspect of the invention, which comprises the reflector and antenna elements shown in FIG. 2. The reflector parts provided with antenna elements are also provided with a respective antenna feeding network module 8*a*-8*f* being electrically connected to the antenna elements. The antenna feeding network modules each comprises a number of transmission lines having an inner conductor arranged in parallel with an elongated outer conductor with air therebetween in the form of coaxial lines, where an inner conductor (9' for example) is surrounded by the outer conductor (9"), and where the space between is substantially air filled (apart from holding elements holding the inner conductor in position, and dielectric elements and associated parts for phase shifting purposes which are not visible in the figure). The antenna feeding network modules are formed integrally with the corresponding reflector part, for instance as an extruded aluminium profile. Antenna feeding network modules 8*a*, 8*c*, 8*d* and 8*f* are disposed substantially perpendicular to the corresponding reflector part in the sense that the inner conductors of the coaxial lines are disposed in two parallel planes which are substantially perpendicular to the corresponding reflector part. Antenna feeding network modules 8*b* and 8*e* are disposed in a conventional manner (in parallel with the corresponding reflector parts).

Figure 4:
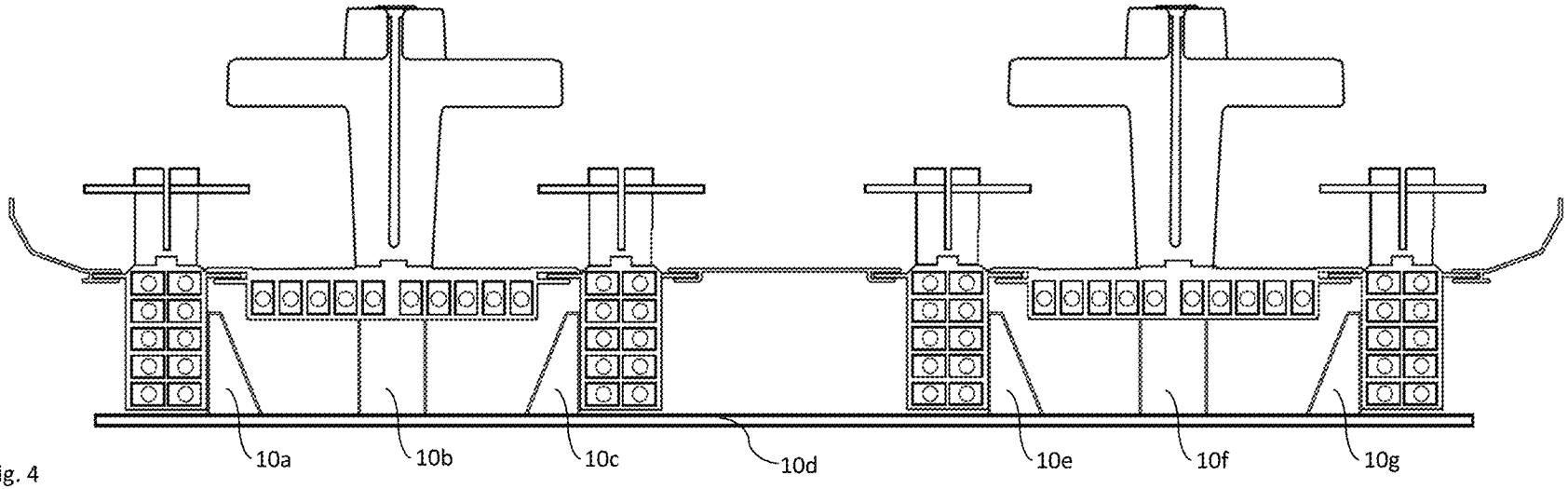
FIG. 4 is a schematic illustration of the multi-array antenna arrangement in FIG. 3, further provided with mechanical connectors.

FIG. 4 is a schematic illustration of the multi-band antenna arrangement in FIG. 3, further provided with mechanical connectors. In this embodiment, the connector devices 3*a*-3*h* primarily function as electrical interconnectors, while mechanical rigidity in the interconnection between the reflector parts is mainly achieved by means of a mechanical connector structure formed by base plate 10*d* to which each reflector part and antenna feeding network module is connected by means of connectors 10*a*-10*g*.

Figure 5:
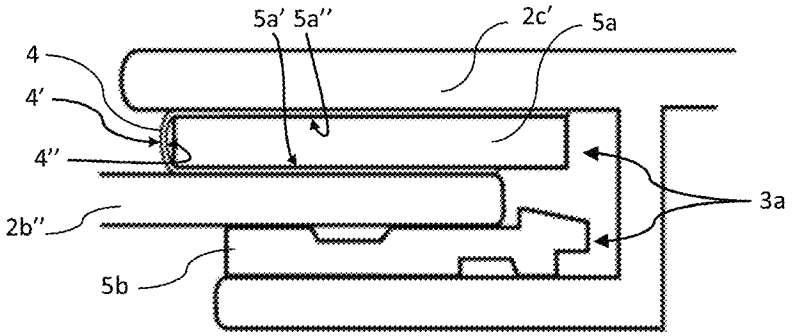
FIG. 5 is a detail view of the interconnection between the second and third reflector part in FIGS. 1-3.

FIG. 5 is a detail view of the interconnection between reflector parts 2*b* and 2*c* in FIGS. 2-4. It is noted that the interconnection between all adjacent reflector parts is achieved in the same manner in this embodiment. Reflector part 2*c* is provided with connecting portion 2*c'* in the form of a cavity in which a protruding connecting portion 2*b"* of reflector part 2*b* and a connector device 3*a* are received. Connector device 3*a* comprises two holding elements 5*a* and 5*b*. A metallic film 4 partly surrounds the periphery of holding element 5*a*. The metallic film 4 is arranged in abutment with connecting portions 2*b"* and 2*c'* of reflector parts 2*b*, 2*c* to achieve the electrical interconnection. The holding element 5*a* has holding portions 5*a'*, 5*a"* connecting to the connecting portions with the metallic film 4 sandwiched therebetween. The metallic film is provided with a dielectric coating/layer 4' arranged on the metallic film the side thereof facing the connecting portions to achieve indirect/capacitive interconnection via the film 4. The holding element 5*a*, 5*b* are non-conductive. The metallic film 4 is attached to the holding element 5*a* by means of an adhesive coating/layer on the side thereof facing the holding element 5*a* to adhere thereto. Holding element 5*a* is made from a resilient material to force the metallic film against the connecting portions to minimize air gaps. Holding element 5*b* is however not resilient to any substantial degree and only acts as a spacing and electrically insulating element. In an alternative embodiment, holding elements 5*a* and 5*b* are formed in one piece, for instance as a substantially U-shaped resilient element into which 2*b"* is received.

Figure 6:
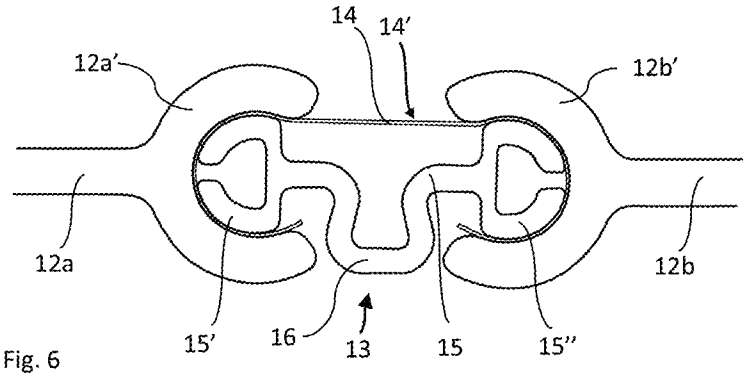
FIG. 6 shows a cross section view of parts of an embodiment of a reflector according to the first or fourth aspect of the invention.

FIG. 6 shows a cross section view of parts of an embodiment of a reflector according to the first or fourth aspect of the invention. In this embodiment, reflector parts 12*a*, 12*b* are electrically indirectly interconnected by means of a connector device 13 which comprises a holding element 15 having holding portions 15' and 15" at opposite end thereof which due to the shown shape and flexible and resilient material of the holding element are compressible to fit snugly into corresponding connecting portions 12*a'*, 12*b'* of the reflector parts 12, 12*b* which are formed as cavities. The holding element comprises a spring portion 16 which forces the holding portions towards the connecting portions. The spring portion is formed integrally with the holding element. The metallic film 14 extends between and around the holding portions by partly surrounding the periphery of the holding element 15. The inherent flexible/bendable properties of the metallic film allow the connector device 13 to compress and expand by means of the spring portion or part to adapt to a varying distance between the reflector parts. A dielectric coating/layer 14' is provided on the metallic film the side thereof facing the connecting portions to achieve indirect/capacitive interconnection via the film 14.

Figure 7:
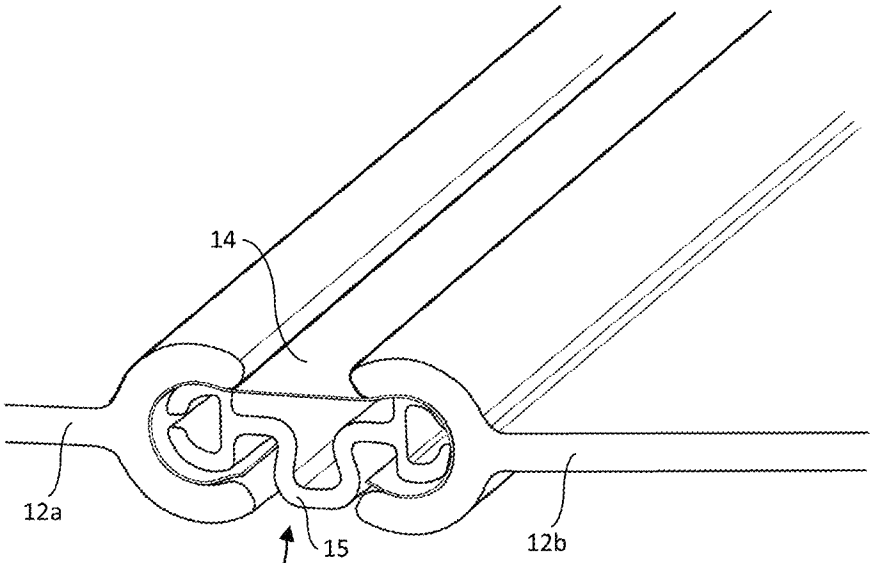
FIG. 7 shows a perspective view of the same embodiment as in FIG. 6.

FIG. 7 shows a perspective view of the same embodiment as in FIG. 6. The connector device 13 as well as its holding element 15 and metallic film 14 extend along the full length of the reflector parts 12*a*, 12*b*.

Figure 8:
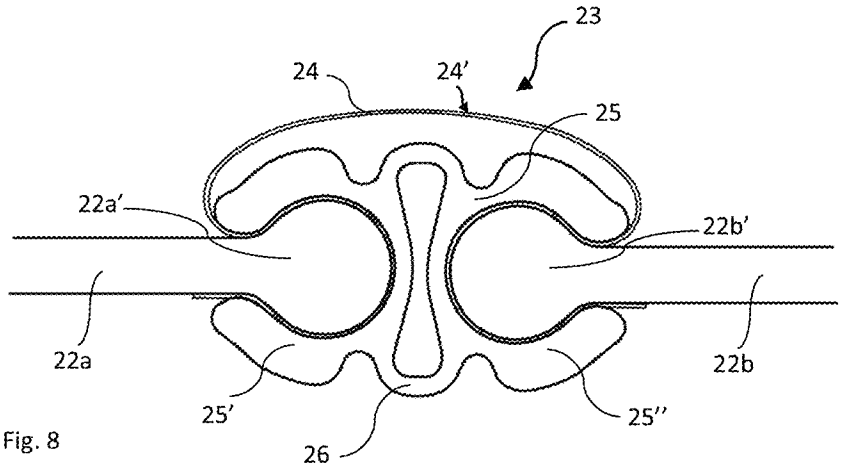
FIG. 8 shows a cross section view of parts of another embodiment of a reflector according to the first or fourth aspect of the invention.

FIG. 8 shows a cross section view of parts of another embodiment of a reflector according to the first or fourth aspect of the invention. In this embodiment, reflector parts 22*a*, 22*b* are electrically indirectly interconnected by means of a connector device 23 which comprises a holding element 25 having holding portions 25' and 25" at opposite end formed as cavities and being formed from the flexible and resilient material of the holding element to receive connecting portions 22*a'*, 22*b'* of the reflector parts 22, 22*b*. In other words, the holding portions 25', 25" engage around the connecting portions 22*a'*, 22*b'*. The holding element comprises a spring portion 26 which forces the holding portions towards the connecting portions. The spring portion is formed integrally with the holding element. The metallic film 24 extends between and within the holding portions by partly surrounding the periphery of the holding element 25. The inherent flexible/bendable properties of the metallic film allow the connector device 23 to compress and expand by means of the spring portion or part to adapt to a varying distance between the reflector parts. A dielectric coating/layer 24' is provided on the metallic film the side thereof facing the connecting portions to achieve indirect/capacitive interconnection via the film 24.

Figure 9:
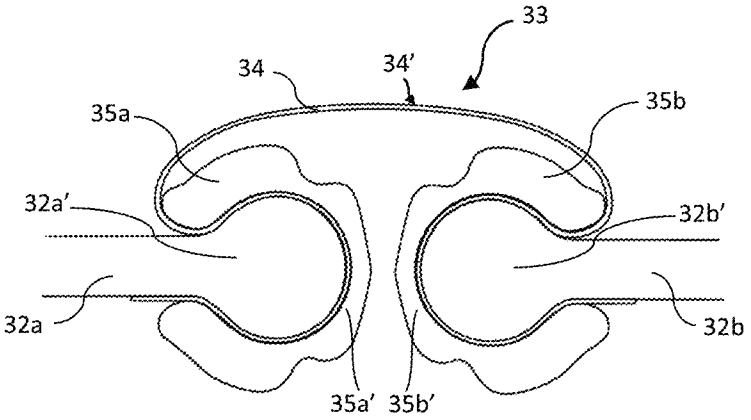
FIG. 9 shows a cross section view of parts of yet another embodiment of a reflector according to the first or fourth aspect of the invention.

FIG. 9 shows a cross section view of parts of yet another embodiment of a reflector according to the first or fourth aspect of the invention. In this embodiment, reflector parts 32*a*, 32*b* are electrically indirectly interconnected by means of a connector device 33 which comprises two holding elements 35*a*, 35*b*, each having a respective holding portion 35*a*' and 35*b*" formed as cavities and being formed from the flexible and resilient material of the holding elements to receive respective connecting portions 32*a*', 32*b*' of the reflector parts 32, 32*b*. In other words, the holding portions 35*a*', 35*b*' engage around the connecting portions 32*a*', 32*b*'. The metallic film 34 extends between and within the holding portions. The inherent flexible/bendable properties of the metallic film allow the connector device 33 to adapt to a varying distance between the reflector parts. A dielectric coating/layer 34' is provided on the metallic film the side thereof facing the connecting portions to achieve indirect/capacitive interconnection via the film 34.

Figure 10:
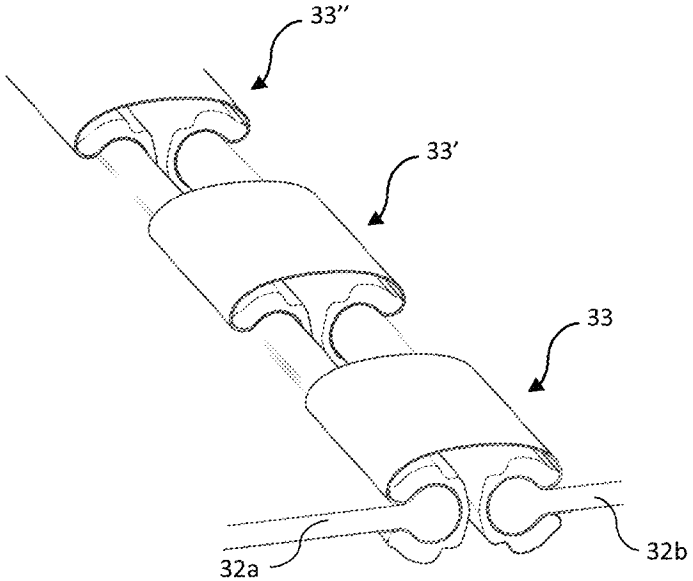
FIG. 10 shows a perspective view of the same embodiment as in FIG. 9.

FIG. 10 shows a perspective view of the same embodiment as in FIG. 9. As can be seen, further identical connector devices are distributed along the length of the reflector parts.

Figure 11:
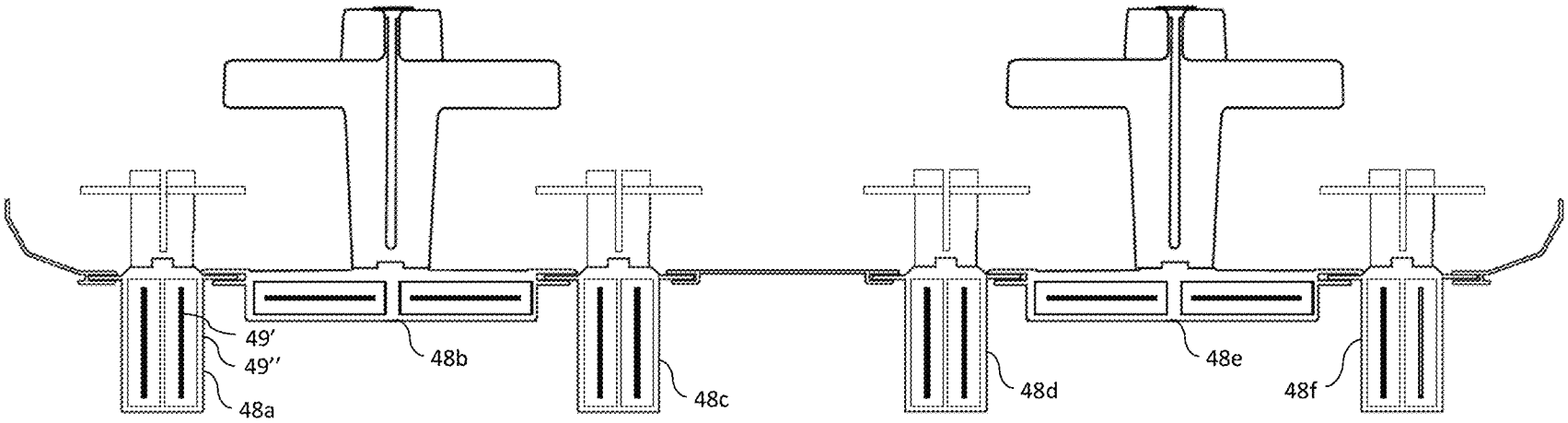
FIG. 11 is a schematic illustration of an alternative embodiment of a multi-array antenna arrangement according to the second or fifth aspect of the invention, which comprises the reflector shown in FIG. 2.

FIG. 11 is a schematic illustration of an alternative embodiment of a multi-array antenna arrangement according to the second or fifth aspect of the invention. Just like the embodiment in FIG. 3, the antenna arrangement comprises the reflector and antenna elements shown in FIG. 2. This alternative embodiment however differs from FIG. 3 in that the antenna feeding network modules 48*a*-48*f* which are electrically connected to the antenna elements are different. Instead of coaxial lines, the modules 48*a-f* are formed as striplines. The transmission lines of the antenna feeding network modules comprise flat conductors/strips (49' for example) placed between two ground planes (49" for example). The striplines have the same function as the coaxial lines in FIG. 3. The spaces between the flat conductors/strips and the ground planes are substantially air filled. The antenna feeding network modules are formed integrally with the corresponding reflector part, for instance as an extruded aluminium profile. Antenna feeding network modules 48*a*, 48*c*, 48*d* and 48*f* are disposed substantially perpendicular to the corresponding reflector part in the sense that the flat conductors/strips are disposed in two parallel planes which are substantially perpendicular to the corresponding reflector part. Antenna feeding network modules 48*b* and 48*e* are disposed in a conventional manner (in parallel with the corresponding reflector parts).

Figure 12:
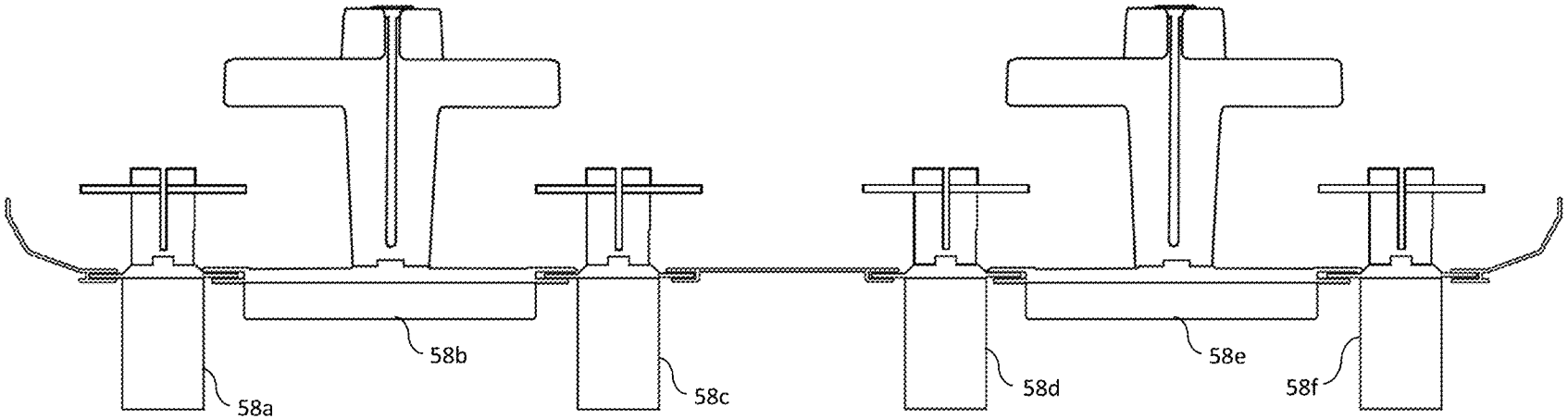
FIG. 12 is a schematic illustration of yet another embodiment of a multi-array antenna arrangement according to the second or fifth aspect of the invention, which comprises the reflector shown in FIG. 2.

FIG. 12 is a schematic illustration of yet an alternative embodiment of a multi-array antenna arrangement according to the second or fifth aspect of the invention. Just like the embodiment in FIGS. 3 and 11, the antenna arrangement comprises the reflector and antenna elements shown in FIG. 2. This alternative embodiment however differs from FIGS. 3 and 11 in that the antenna feeding network modules 58*a*-58*f* which are electrically connected to the antenna elements are different. Instead of coaxial lines or striplines, the modules 58*a-f* are formed using commonly available (bendable) coaxial cables using e.g. PTFE as dielectric. Such cables are considered well known to the person skilled in the art and are therefore not shown.

The description above and the appended drawings are to be considered as non-limiting examples of the invention. The person skilled in the art realizes that several changes and modifications may be made within the scope of the invention. For example, the interconnection between the reflector parts in the embodiments in FIGS. 2-4 and 11-12 can be replaced with any of the interconnections shown in FIGS. 6-10. Further, the number of arrays, reflector parts and combinations thereof can be different. Further, one or more reflector parts may be provided with two or more arrays. Also the feeding networks can be made with different combinations of transmissions lines such as those shown in FIGS. 3, 11 and 12.

The invention claimed is:

1. A reflector for a multi-radiator antenna, said reflector comprising:

at least two electrically conducting reflector parts each having at least one connecting portion;

at least one connector device adapted to provide an electrical interconnection between at least two of the reflector parts, each connector device comprising a metallic film adapted to be arranged in abutment with connecting portions of said at least two of the reflector parts to achieve said electrical interconnection, and one or more holding elements, wherein at least one of the holding elements has at least one holding portion adapted to connect to a connecting portion of a reflector part with said metallic film sandwiched therebetween, wherein the electrical interconnection is indirect by means of a dielectric coating or layer arranged on the metallic film and/or on the connecting portions, or by means of a dielectric film arranged between the metallic film and the connecting portions.

2. The reflector according to claim 1, wherein said dielectric coating or layer is arranged on the metallic film on at least the side thereof facing the connecting portions.

3. The reflector according to claim 1, wherein at least one holding element is at least partly made from a resilient material to force the metallic film against the connecting portions of said at least two of the reflector parts.

4. The reflector according to claim 1, wherein at least the holding portions of at least one holding element are resilient to force the metallic film against the connecting portions of said at least two of the reflector parts.

5. The reflector according to claim 1, wherein the holding element comprises at least one spring portion adapted to force the at least one holding portion towards said connecting portion.

6. The reflector according to claim 1, wherein at least one holding portion of the at least one holding element is configured to connect with a corresponding connecting portion of a reflector part by means of abutting contact therewith.

7. The reflector according to claim 1, wherein at least one holding portion of the at least one holding element is configured to connect with a corresponding connecting portion of a reflector part by engaging around at least parts of said connecting portion.

8. The reflector according to claim 1, wherein at least one holding element or at least one holding portion of the at least one holding element is resiliently compressible and is configured to connect with a corresponding connecting portion of a reflector part by means of said connecting portion being formed as a cavity into which said holding portion is releasably insertable.

9. The reflector according to claim 1, comprising first and second reflector parts, wherein the first reflector part comprises a first connecting portion formed as a protrusion, and wherein the second reflector part comprises a second connecting portion formed as a cavity adapted to receive said first connecting portion and a connector device to electrically interconnect said first and second reflector parts, said connector device having a holding element being at least partly resiliently compressible and being adapted to connect to the first and second connecting portions with said metallic film or said metallic film and said dielectric film sandwiched therebetween.

10. The reflector according to claim 1, wherein at least one connector device comprises at least one holding element having at least two holding portions, and wherein the metallic film extends between the holding portions by at least partly surrounding the periphery of the holding element.

11. The reflector according to claim 1, wherein at least one connector device is adapted to interconnect said at least two of the reflector parts capacitively.

12. The reflector according to claim 1, wherein at least one connector device extends along essentially the whole length of the reflector parts when connected thereto.

13. The reflector according to claim 1, wherein at least one connector device comprises at least two holding elements adapted to be arranged consecutively along the length of the reflector parts to connect to a connecting portion of a reflector part with said metallic film sandwiched therebetween.

14. The reflector according to claim 1, wherein at least two connector devices are arranged consecutively along the length of the reflector parts when connected thereto.

15. The reflector according to claim 1, wherein said at least one holding element is non-conductive.

16. The reflector according to claim 1, wherein said reflector comprises at least two parallel reflector portions to form a reflector for a multi-array antenna arrangement having at least two arrays of antenna elements, wherein at least one reflector portion is formed by at least two reflector parts.

17. A multi-array antenna arrangement comprising a reflector according to claim 1, wherein at least two of the reflector parts are each provided with an antenna feeding network module and at least two antenna elements arranged on the reflector part and being electrically connected to said antenna feeding network module.

18. The multi-array antenna arrangement according to claim 17, wherein said antenna feeding network module comprises at least two transmission lines being coaxial lines having at least one inner conductor being at least partly surrounded by an elongated outer conductor with air therebetween.

19. The multi-array antenna arrangement according to claim 17, wherein said antenna feeding network module comprises at least two transmission lines having at least one flat conductor placed between two ground planes or essentially interacting only with one ground plane.

20. The multi-array antenna arrangement according to claim 17, wherein said antenna feeding network module comprises at least two transmission lines being bendable coaxial cables using for instance PTFE or PE as dielectric.

21. The multi-array antenna arrangement according to claim 18, wherein at least one antenna feeding network module is arranged substantially perpendicular to the corresponding reflector part.

22. The multi-array antenna arrangement according to claim 17, wherein at least one reflector part along with the corresponding antenna feeding network module and antenna elements forms a multi-radiator antenna having its reflector formed partly by said reflector part and partly by one or more adjacent reflector parts.

* * * * *